US010376121B2

(12) United States Patent
Anderson et al.

(10) Patent No.: US 10,376,121 B2
(45) Date of Patent: Aug. 13, 2019

(54) SQUEEGEE WITH SEAL FLAP

(71) Applicant: Midwest Rubber Service & Supply Company, Plymouth, MN (US)

(72) Inventors: Brent Anderson, Brooklyn Park, MN (US); A.L.F. Meijdam, Voorthuizen (NL)

(73) Assignee: Midwest Rubber Service & Supply Company, Plymouth, MN (US)

( * ) Notice: Subject to any disclaimer, the term of this patent is extended or adjusted under 35 U.S.C. 154(b) by 0 days.

(21) Appl. No.: 15/246,149

(22) Filed: Aug. 24, 2016

(65) Prior Publication Data

US 2017/0055795 A1 Mar. 2, 2017

Related U.S. Application Data

(60) Provisional application No. 62/210,003, filed on Aug. 26, 2015.

(51) Int. Cl.

| | |
|---|---|
| ***A47L 11/40*** | (2006.01) |
| ***A47L 11/20*** | (2006.01) |
| ***A47L 11/30*** | (2006.01) |

(52) U.S. Cl.

CPC ..... *A47L 11/4044* (2013.01); *A47L 11/201* (2013.01); *A47L 11/305* (2013.01); *A47L 11/4016* (2013.01); *A47L 11/4083* (2013.01)

(58) Field of Classification Search

CPC ..... A47L 11/4044; A47L 11/305
USPC ..... 15/401, 402, 245, 250.49
See application file for complete search history.

(56) References Cited

U.S. PATENT DOCUMENTS

| | | | | |
|---|---|---|---|---|
| 930,134 | A * | 8/1909 | Blackall | A47L 11/4044 119/606 |
| 1,849,663 | A | 3/1932 | Finnell | |
| 3,019,462 | A * | 2/1962 | Nash | A47L 9/02 15/1.7 |
| 3,107,387 | A | 10/1963 | Katt | |
| 3,520,012 | A | 7/1970 | Carabet | |
| 4,817,233 | A | 4/1989 | Waldhauser | |

(Continued)

FOREIGN PATENT DOCUMENTS

| | | | |
|---|---|---|---|
| JP | 2007089725 | A | 4/2007 |
| WO | 2010107432 | A1 | 9/2010 |

OTHER PUBLICATIONS

European Extended Search Report for EP Application No. EP16185724 dated Jan. 25, 2017, 7 pages.

*Primary Examiner* — Joseph J Hail
*Assistant Examiner* — Henry Y Hong
(74) *Attorney, Agent, or Firm* — Moss & Barnett; Glen E. Schmann

(57) ABSTRACT

The present invention relates generally to a surface cleaning squeegee assembly and more specifically to a squeegee assembly mounted on a scrubber-dryer floor cleaning machine. The squeegee assembly includes a front squeegee having a number of spaced channels along a lower edge covered by seal flaps, and a rear squeegee having no channels. The front and rear squeegees define a vacuum chamber between them. Air, dirty water and surfactant are vacuumed into the vacuum chamber through the front squeegee channels for ultimate disposal. When the scrubber-dryer surface cleaning machine traverses over an uneven surface, the seal flaps close the channels to limit or eliminate any vacuum loss to the vacuum chamber.

13 Claims, 5 Drawing Sheets

(56) References Cited

U.S. PATENT DOCUMENTS

| | | | | |
|---|---|---|---|---|
| 4,951,341 | A | 8/1990 | Shears | |
| 5,212,848 | A | 5/1993 | Geyer | |
| 5,280,666 | A * | 1/1994 | Wood | A47L 7/0009 15/328 |
| 5,377,382 | A | 1/1995 | Bores | |
| 5,918,346 | A * | 7/1999 | Suzuki | A47L 11/4044 15/320 |
| 5,933,911 | A | 8/1999 | Windmeisser | |
| 6,047,437 | A * | 4/2000 | Suzuki | A47L 11/4044 15/245 |
| 6,108,859 | A | 8/2000 | Burgoon | |
| 6,647,585 | B1 | 11/2003 | Robinson | |
| 9,038,237 | B2 | 5/2015 | Wood | |
| 2003/0028995 | A1 * | 2/2003 | Ikeda | A47L 1/06 15/401 |
| 2004/0154123 | A1 | 8/2004 | Christopher | |

* cited by examiner

SQUEEGEE WITH SEAL FLAP

CROSS REFERENCE TO RELATED APPLICATION

This application claims priority to U.S. Provisional Application 62/210,003 filed on Aug. 26, 2015, which is hereby incorporated by reference in its entirety.

FIELD OF INVENTION

The present invention relates generally to a scrubber-dryer surface cleaning machine and more specifically to a squeegee assembly mounted on a scrubber-dryer floor cleaning machine. The squeegee assembly defines a vacuum chamber between a front and rear squeegee. The squeegees form a partial seal with a surface to be cleaned, such as a floor. Dirty water and surfactant mixture from the cleaning process is directed to the vacuum chamber and the dirty water is drawn by a vacuum from the vacuum chamber to a dirty water tank for subsequent disposal.

BACKGROUND OF THE INVENTION

In the global floor care industry, scrubber-drier floor cleaning machines apply water and surfactant to floors, loosen dirt and debris with brushes or pads, and remove the suspended soils and liquids to a dirty water tank with a vacuum system. The last part of the scrubber-drier that touches the floor is a squeegee. The squeegee determines how much water, dirt and surfactant is removed from the floor and how much is left behind.

A traditional squeegee assembly contains a front channeled squeegee and a rear un-channeled squeegee in close proximity. The squeegees have a generally rectangular shape and a lower, generally linear, edge for contacting a floor. The front and back squeegees are located in close proximity to create a vacuum chamber.

The rear squeegee is in contact with the floor and collects the dirty water and surfactant or soap solution in the vacuum chamber for pickup. The front squeegee contains slotted channels to control the entry of airflow and dirty water/surfactant into the vacuum chamber. Collected dirty water and surfactant are vacuumed to the dirty water tank for disposal.

The slotted channels of the front squeegee have a fixed size and configuration which is not adjustable. Thus, when a scrubber-drier floor cleaning machine traverses over an uneven floor surface (example: grouted tile), the squeegees will partially or wholly lose contact with the floor. This causes a loss of vacuum pressure due to the additional volume of air entering the vacuum chamber due to a seal break between the uneven floor surface and the generally linear surfaces of the squeegee lower edges. The result is that dirty water and surfactant are left behind on the floor.

Additionally, as the front squeegee wears, the overall water pick-up performance of the scrubber-drier machine will degrade until total failure of the squeegee, again due to a breakdown of the seal created between the squeegee and the floor. At this point, both the front and rear squeegees will typically need to be replaced.

The quality of floor cleaning is dependent on the ability of the squeegee assembly to allow dirty water and surfactant to enter the vacuum chamber of the scrubber-dryer and still maintain a sufficient seal with the floor so the vacuum system is not compromised. This is particularly true when cleaning uneven surfaces. Therefore, there have been a number of attempts to address the issue of maintaining a seal between the squeegee assembly and a floor while drawing dirty water and surfactant into the vacuum chamber of the scrubber-dryer machine.

U.S. Pat. No. 5,212,848 to Geyer discloses the addition of small spaced protuberances along the lower edge of the squeegee blade on the side of the squeegee assembly that leads when the scrubber-dryer moves backward. The protuberances permit water to enter the vacuum area of the scrubber-dryer when the machine moves backward by breaking the blade seal with the surface being cleaned.

U.S. Pat. No. 3,520,012 to Carabet et. al. discloses a squeegee blade with raised bumps along a front surface of the blade tip. In use, the lip bends backwards (when moving forward) and the bumps cause the lip to move up, permitting air and liquid to flow beneath the lip through the spaces between bumps.

U.S. Pat. No. 4,817,233 to Waldhauser discloses the use of corrugations or channels through the front blade and rear blade. On the front blade, the channels are open to permit liquid to flow through the blade when moving in a direction into the fluid, but an inner flap of the blade prevents fluid from moving through the blade when the cleaning machine is moved in an opposite direction, toward fluid accumulated behind the front blade.

U.S. Pat. No. 6,647,585 to Robinson discloses a floor-cleaning tool that includes a diverter capable of selectively directing a flow of a pressurized liquid from an inlet to either a first outlet or a second outlet. The tool utilizes parallel squeegee blades (44 *a, b* in the patent). In one embodiment, the blades appear to be corrugated on one side, smooth on the other, to allow fluid to pass between the troughs created on the corrugated side when the tool is moved in the direction of the corrugated side of the blades.

U.S. Pat. No. 5,918,346 to Suzuki discloses the use of a flexible blade having a serrated configuration, comprising a plurality of blade surfaces arranged adjacent to one another along a longitudinal dimension, the lower edges of the blade surfaces being slanted relative to a plane of the floor surface when not in contact with the floor surface.

U.S. Patent Publication No. US 2003/0028995 to Ikeda discloses the use of a flexible squeegee blade that engages the floor surface at an approximate 45 degree angle. When downward pressure is applied to the squeegee blade, a greater area of a lip of the squeegee blade is forced into contact with the floor surface to increase the wiping efficiency of the squeegee blade.

U.S. Pat. No. 9,038,237 to Wood discloses a squeegee assembly that includes front and rear flexible blades, each with a wiping edge. The rear blade includes at least one aperture extending there through in spaced relation from the wiping edge to improve air flow into the vacuum system.

U.S. Pat. No. 6,108,859 to Burgoon discloses a squeegee having a series of upwardly extending openings spaced along the lower edge of the squeegee. The openings are tapered as they extend upward from the lower edge of the squeegee. The wider gap in the openings, along the lower edge of the squeegee, permit liquid to pass through the squeegee. The narrower gap at the upper end of each opening limits passage of ambient air to help maintain a seal with the floor.

U.S. Pat. No. 5,933,911 to Windmeisser discloses the use of blades made of strips of adjacent ribbed rubber material.

U.S. Pat. No. 5,377,382 to Bores et. al. discloses the use of squeegee blades having slits for the passage of dirty water and soap.

U.S. Pat. No. 4,951,341 to Shears discloses the use of radially aligned bands of flaps positioned in side to side relation to one another on a support base. Slits are provided in the flaps.

U.S. Pat. No. 3,107,387 to S. Katt discloses an apertured blade tip.

U.S. Pat. No. 3,019,462 to Nash et. al. discloses a flexible blade tip in the shape of a diamond.

U.S. Pat. No. 1,849,663 to Finnell discloses a cleaning machine that utilizes a front blade with notches.

None of this prior art has resulted in a satisfactory squeegee assembly that has the ability to allow dirty water and surfactant to enter the vacuum chamber and still provide an adequate seal between the squeegee and the floor, particularly on an uneven surface.

SUMMARY OF INVENTION

The present invention is a squeegee assembly for cleaning a surface, and more specifically, a squeegee assembly for a scrubber-dryer surface cleaning machine.

The squeegee assembly includes a front squeegee and rear squeegee that define a vacuum chamber there between. The front squeegee has a lower edge and a desired number of spaced channels defined in the lower edge through which air, dirty water and surfactant are drawn to the vacuum chamber.

The channels are each equipped with flexible seal flaps. A seal flap is positioned within each channel and partially extends beyond a lower edge of the front squeegee to engage the surface to be cleaned. The seal flap can move between a closed position, within the channel, and an open position at least partially positioned outside the channel.

During normal operation, the seal flap will be drawn, by engagement with the surface to be cleaned, to an open position that will allow air, dirty water and surfactant to enter the vacuum chamber through the front squeegee channels. However, if the front squeegee lower edge loses contact with the floor due to uneven floor conditions (such as tiles with deep or wide grout lines), the seal flaps will close partially or completely to reduce or eliminate loss of vacuum pressure to the vacuum chamber. Thus, vacuum performance of the squeegee assembly is improved over uneven surfaces by the seal flap acting as a valve that closes when the squeegee lower edge breaks from the floor, to reduce or eliminate loss of vacuum performance. The squeegee assembly of the present invention also increases the life expectancy of the squeegees since the squeegees can maintain a seal with a floor over a greater period of use/time.

BRIEF DESCRIPTION OF THE DRAWINGS

Referring now to the drawings, wherein like reference numerals indicate corresponding structure through the several views.

DETAILED DESCRIPTION OF THE INVENTION

For a thorough understanding of the present disclosure, refer to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

Although the present invention is designed for many uses, for exemplary purposes only, the invention is described herein as a squeegee assembly for a scrubber-drier floor cleaning machine used to clean floors.

Figure 5:
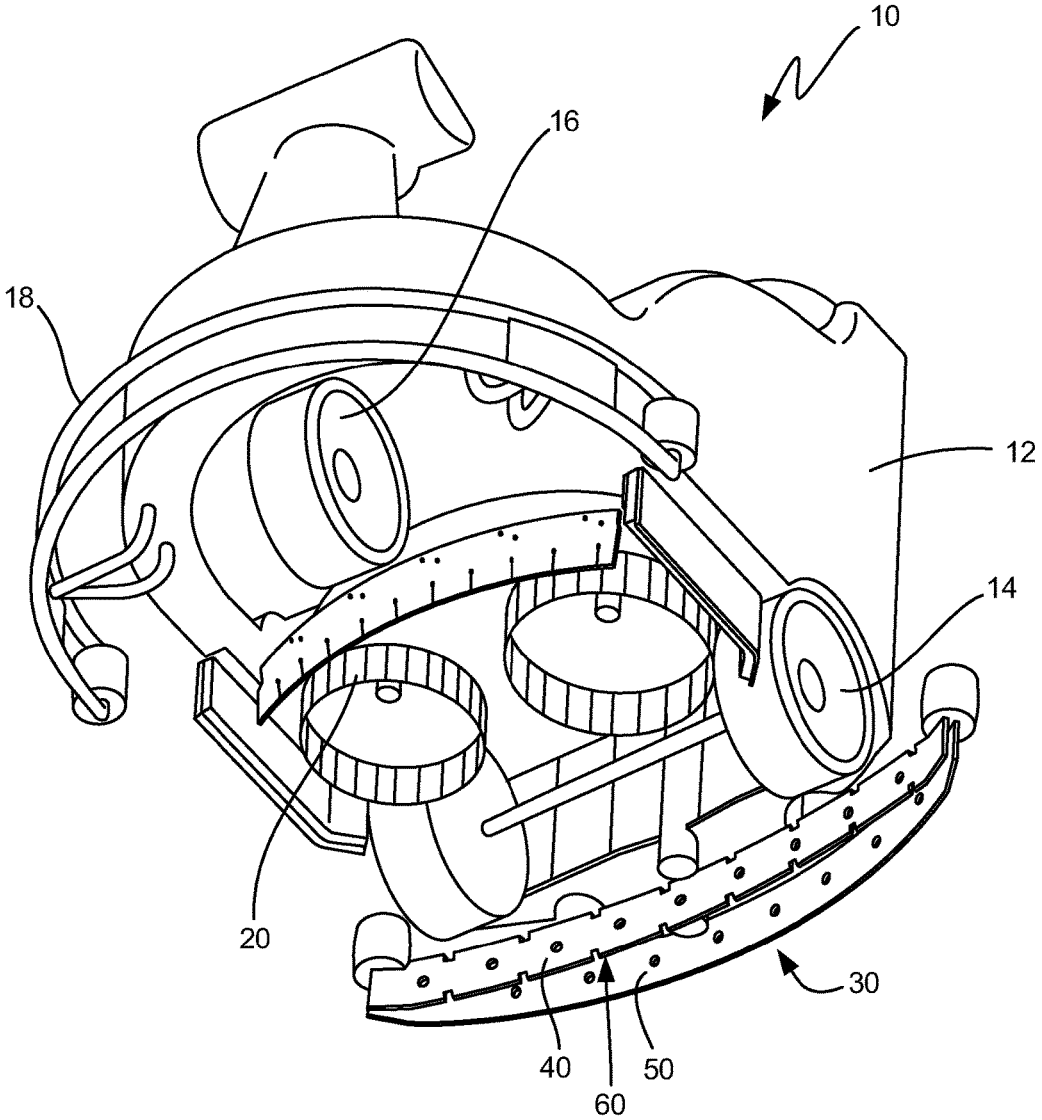
FIG. 5 is a traditional scrubber-dryer surface cleaning machine with a standard front and rear squeegee mounted thereon.

A traditional scrubber-drier floor cleaning machine is shown at 10 in FIG. 5. The cleaning machine typically includes a body 12, rear wheels 14, at least one steering wheel 16, scrubbing brushes or pads 20 and a squeegee assembly 30 that includes a front squeegee 40 and rear squeegee 50 in close proximity, defining a vacuum chamber 60 there between. A guard 18 at the front of the cleaning machine prevents damage to the cleaning machine if an obstacle is accidently contacted.

Although not shown, the scrubber-drier also includes a clean water tank, surfactant dispenser, a dirty water tank and a vacuum operatively connected by a vacuum hose to the dirty water tank and the vacuum chamber 60 of the squeegee assembly 30.

In operation, clean water and surfactant are sprayed on a floor 80. Brushes 20 scrub the floor, leaving a residue of dirty water and surfactant. The dirty water and surfactant are drawn by the vacuum into the vacuum chamber of the squeegee assembly and then to the dirty water tank for eventual disposal. Generally, the total volume of the sum of the channel volume capacity is correlated to the size of the vacuum hose and the volume of air flowing through the vacuum chamber to size the vacuum and dirty water tank.

Figure 6:
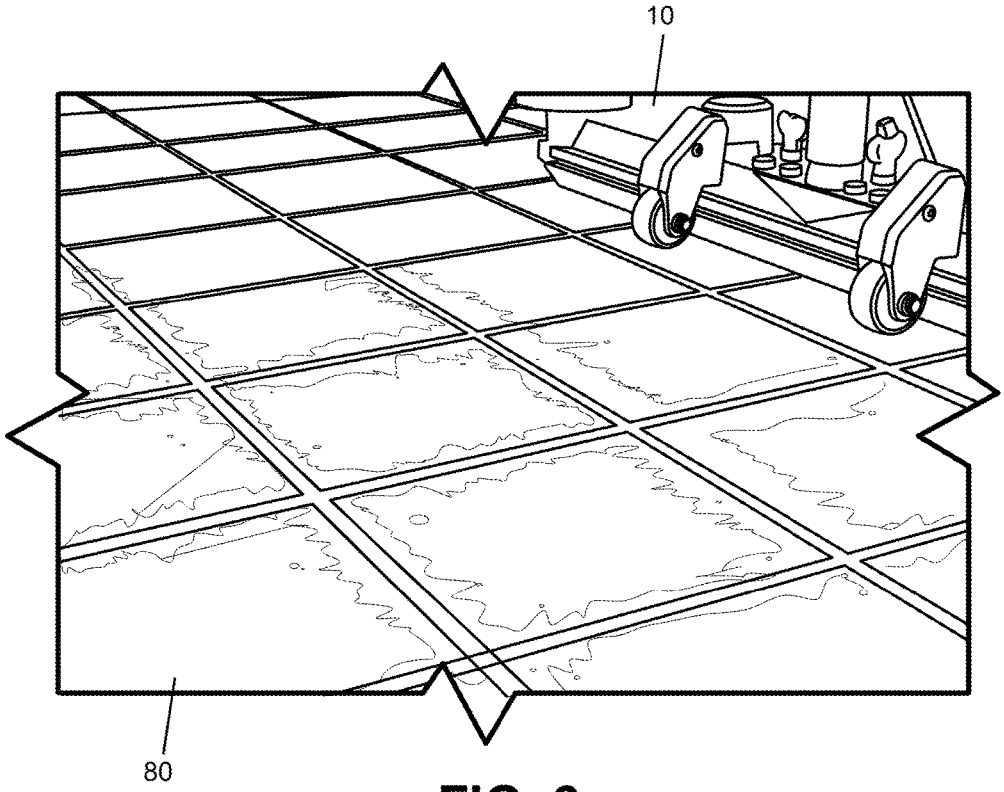
FIG. 6 illustrates water left behind by a traditional squeegee after the scrubber-dryer floor cleaning machine has passed over an uneven (grouted tile) surface.

In order for the vacuum operation to function properly, a partial seal must be maintained between the front squeegee and floor and a full seal must be maintained between the rear squeegee and the floor. However, when a scrubber-drier floor cleaning machine traverses over an uneven floor surface (example: grouted tile), the squeegee assembly will partially or wholly lose contact with the floor. This causes a loss of vacuum pressure due to the additional volume of air that is able to enter the vacuum chamber between the bottom edges of the squeegees and the floor surface. The result is that dirty water and surfactant will be left behind due to a break in the seals between the squeegees and the floor as shown in FIG. 6.

Further, as the front squeegee wears, the overall water pick-up performance of the scrubber-drier machine will degrade until total failure of the squeegee. At this point, both the front and rear squeegees will typically need to be replaced.

Figure 1:
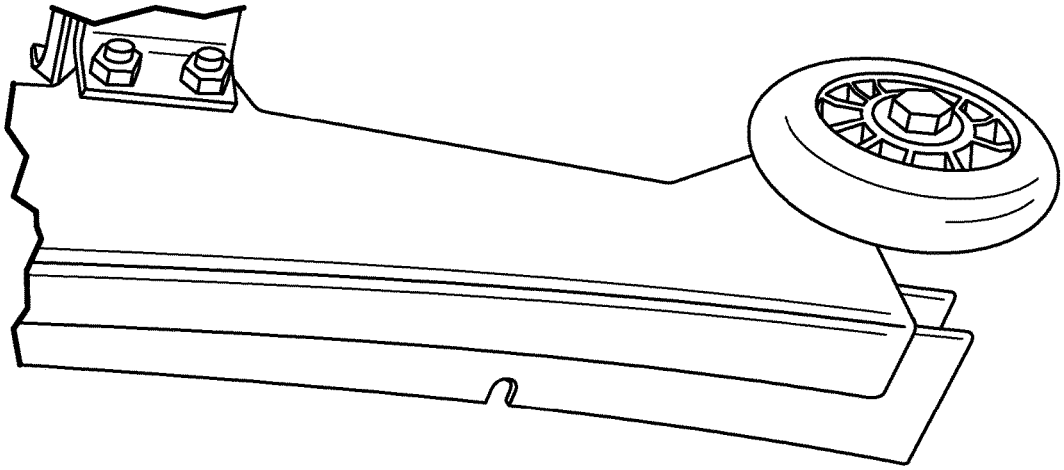
FIG. 1 illustrates a partial traditional channeled squeegee with a rear and front squeegee.
Figure 2:
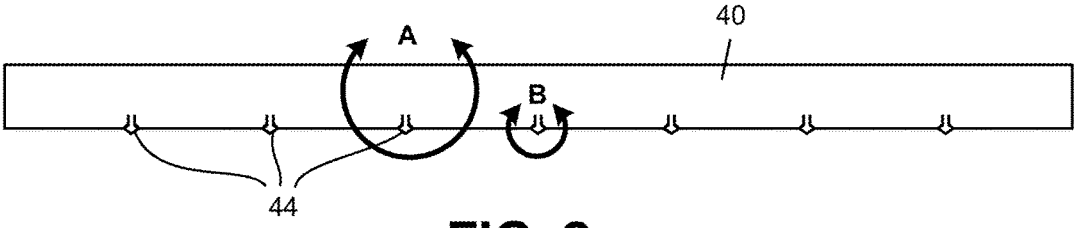
FIG. 2 illustrates one embodiment of the front squeegee of the present invention.
Figure 3:
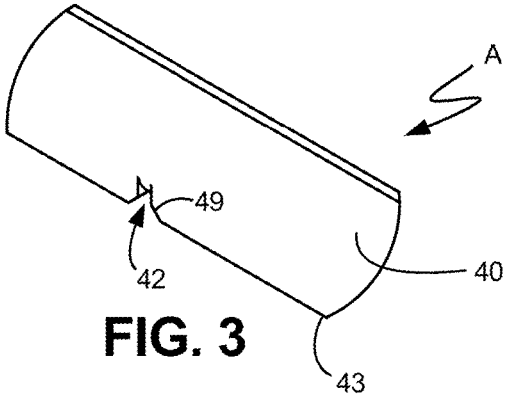
FIG. 3 illustrates a portion of the front squeegee of the present invention with the seal flap in the open position.
Figure 4:
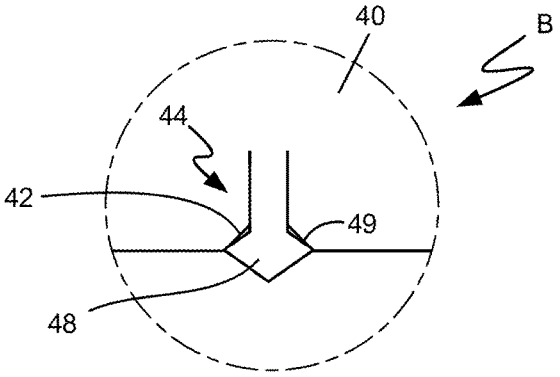
FIG. 4 illustrates a detail of a seal flap taken along the line B in FIG. 2 with the seal flap in closed position.

The squeegee assembly of the present invention offers significant advantages over the prior art. The front squeegee 40, as best shown in FIGS. 2-4, consists of a generally rectangular strip of rubber or other flexible material having a lower edge 43 for engaging a surface to be cleaned (typically a floor, but not limited to such). Along the lower edge 43 of the squeegee 40 are defined a number of spaced channels 42. The channels 42 or slots in the front squeegee 40 provide an opening for air and dirty water and surfactant to enter or be drawn into the vacuum chamber 60 at the discrete channel locations. Each channel 42 has a distal end and a proximal end where the distal end is at the lower edge 43. Each channel 42 has a length between distal end and the proximal end thereof. In one preferred embodiment, the channels 42 are narrower at the top and wider at the bottom to allow air, dirty water and surfactant to flow through the channels 42, but other configurations of channels 42 are anticipated by the present invention.

The rear squeegee 50 of the present invention is also made of rubber or other flexible material and has no channels. The rear squeegee is in contact with the floor and collects and holds the dirty water and surfactant solution within the squeegee assembly vacuum chamber until drawn to the dirty water tank by the vacuum.

Figure 7A:
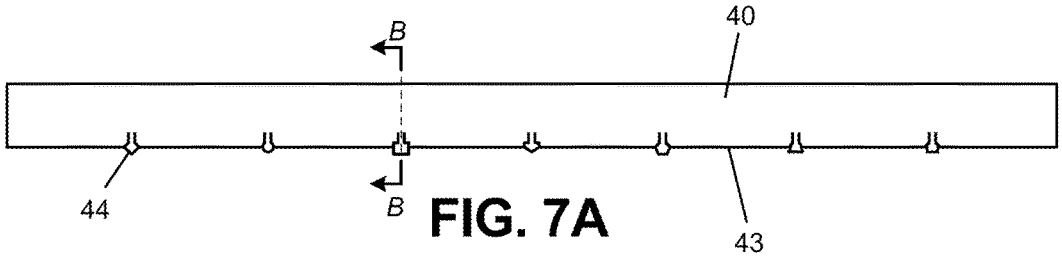
FIG. 7A illustrates other configurations of seal flaps on a squeegee of the present invention.
Figure 7B:
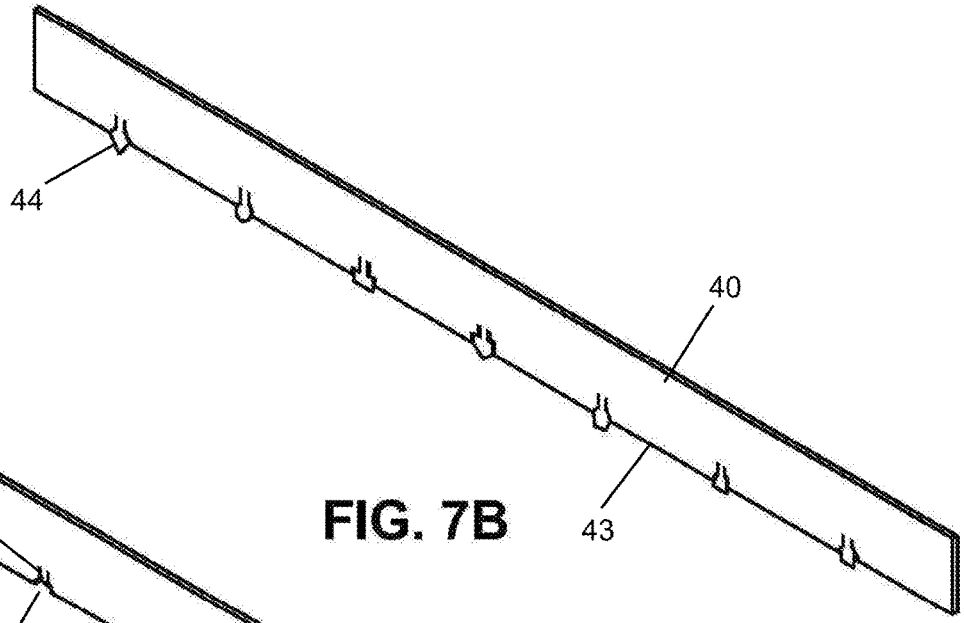
FIG. 7B is a perspective view of the squeegee of FIG. 7A where the seal flaps are in a closed position.
Figure 8:
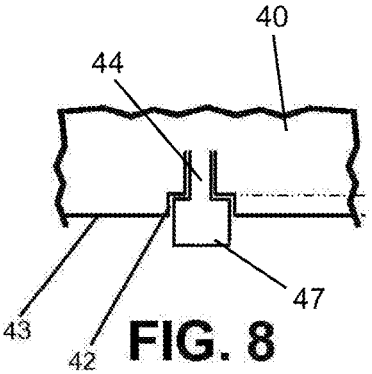
FIG. 8 is an enlarged front view of the squeegee in FIG. 7A.

Most or all of the channels 42 are covered by seal flaps 44. Each seal flap 44 has a distal end and a proximal end and is mounted with respect to the channel 42 so that the proximal end of the seal flap 44 is attached to the front squeegee 40 at the proximal end of the channel 42, as illustrated in FIGS. 7A, 7B and 8. Each seal flap 44 has a length between the distal end and the proximal end thereof. The length of the seal flap 44 may be greater than the length of the channel 42. In one preferred embodiment, the seal flaps 44 have a rectangular base 47 and a projection or engagement/wear surface 48 having a diamond configuration (half diamond or triangular configuration extending below the lower edge of the front squeegee) so that edges of the seal flap 44 that define the half-diamond configuration are oriented in a plane of the front squeegee 40 when in the closed position, as shown in FIG. 4. However, other configurations of the base and projections are anticipated by the present invention, including without limitation, a square, rectangle, triangle, circle, semi-circle (two dimensional configurations with some width) and cubes, spheres, polyhedrons, etc. (three dimensional configurations). See FIGS. 7A and 7B.

In one preferred embodiment, the seal flaps 44 are formed, manufactured or constructed so that they are biased in the closed position within the channel 42 to substantially block or reduce air, dirty water and surfactant from entering the vacuum chamber. When the seal flap 44 is in a closed position, the distal end of the seal flap 44 is in direct contact with the front squeegee 40 to substantially seal the channel 42 as illustrated in FIGS. 4, 7A, 7B and 8. When the seal flap 44 is in an open position, the distal end of the seal flap 44 is not in direct contact with the front squeegee 40 as illustrated in FIG. 3.

In one embodiment, as illustrated in FIGS. 7A, 7B and 8, the channel 42 has a first length between distal end and the proximal end thereof. The seal flap 44 has a second length between the distal end and the proximal end thereof. The second length is greater than the first length so that the seal flap 44 projections extend beyond the lower edge 43 of the front squeegee 44 to engage the floor when the scrubber-dryer surface cleaning machine is moved forward to clean a floor. The frictional contact of the seal flaps 44 and the floor cause the seal flap 44 to be drawn out of the channel 42, in a direction opposite the direction of movement of the scrubber-dryer surface cleaning machine, allowing air, dirty water and surfactant to pass through the channels 42 into the vacuum chamber.

Figure 7C:
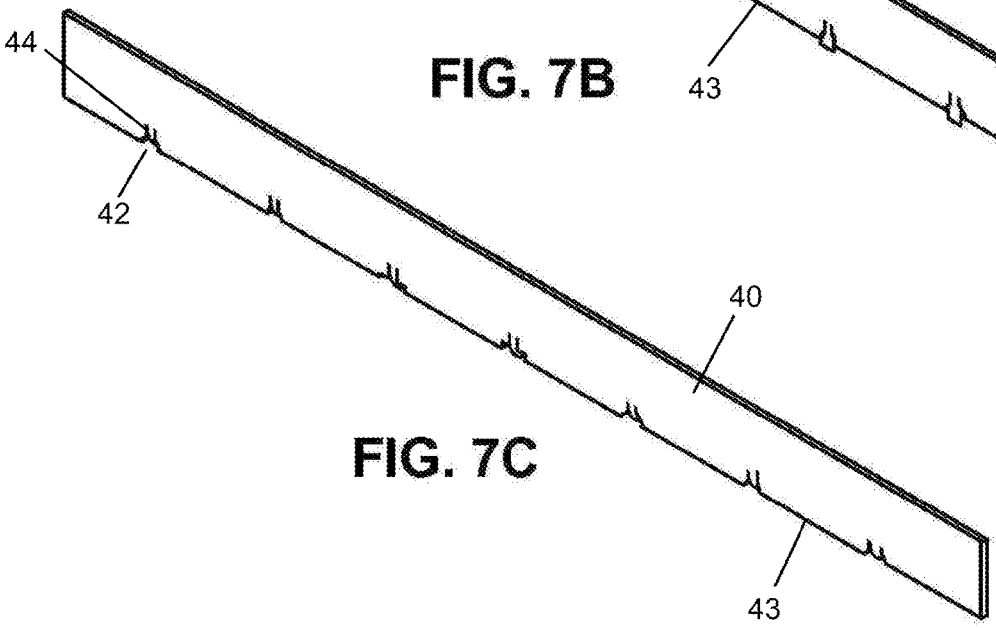
FIG. 7C is a perspective view of the squeegee of FIG. 7A where the seal flaps are in an open position.

In another embodiment, the seal flaps may be flush or short of the lower edge of the front squeegee. Starting the vacuum causes the seal flaps to be drawn out of the channels, allowing air, dirty water and surfactant to pass through the channels into the vacuum chamber. In FIG. 7, the projections or wear surfaces are shown partially above and below the lower edge of the front squeegee. Other embodiments of seal flaps, drawn out of the channels by both friction and vacuum or by other means, are anticipated by the present invention.

In one preferred embodiment, the flaps are formed integrally with the front squeegee, connected at the top of the seal flap to the rest of the front seal flap. The flexible material of the squeegee/seal flaps allows the seal flaps to flex between an open position with the seal flap partially or substantially retracted behind its corresponding channel and a closed position with the seal flap positioned within or over the channel opening.

In other embodiments, the seal flaps may be more rigid and the manner in which the seal flaps are secured to the front squeegee permit the seal flaps to move or swing between its open and closed positions (such as a spring-loaded, hinged seal flap biased in the closed position by the spring).

In one preferred configuration, the seal flap generally mates with the configuration of the channel so that the seal flap and channel form a seal when the seal flap is in a closed position, assuring limited air, dirty water and surfactant can be drawn through the channel by the vacuum. In other preferred embodiments, the closure of the seal flaps on the channels may permit measured flow of air, dirty water and surfactant through the channels.

The number, spacing and configuration of the channels and seal flaps can be customized for specific uses and optimal performance.

The vacuum performance of the squeegee assembly of the present invention is improved over uneven surfaces. During operation, if the front squeegee loses contact with the floor due to uneven floor conditions, the seal flaps, naturally biased in the closed position, will close partially or fully to minimize or eliminate gaps between the lower edge of the front squeegee and the floor. This action reduces or eliminates the loss of the vacuum performance by concentrating/shifting the airflow/suction pressure away from the normal channel openings to the location of other breaks between the lower edge of the front squeegee and the floor created by the uneven floor condition.

The seal flap design of the present invention provides improved initial water pickup performance over the prior art and helps to maintain this performance advantage over the life of the squeegee, despite the fact that the squeegee material wears down over time. This is contrary to expected performance degradation over time of prior art channel front squeegees.

This squeegee of the present invention can be used for applications beyond the global floor care industry. The invention can be utilized for all squeegee applications—any fluid control/transfer applications that require a partial seal and a re-direction of present solution within the environment. For example, such applications can be found in the following industries:

Printing industry
Pipeline cleaning industry
Conveyor belting industry
Window cleaning industry
Street cleaning industry
Solar panel cleaning industry
Automotive industry.

The squeegee can be constructed from a wide range of natural and synthetic materials, including but not limited to:

Rubber
Polyurethane
Silicone
Fabric
Plastic.

The squeegee can also be fabricated by injection molding, cast molding, compression molding, open cast, extruded or fabricated from sheet material (i.e. die cut, CNC cut, waterjet).

The invention claimed is:

1. A squeegee assembly for a surface cleaning machine that is movable in a first direction, the squeegee assembly including:

a. a front squeegee having a lower edge for engaging a surface to be cleaned, the lower edge having at least one channel formed therein, wherein the channel has a distal end and a proximal end where the distal end is at the lower edge, a seal flap having a distal end and a proximal end, wherein the seal flap is mounted with respect to the at least one channel so that the proximal end of the seal flap is attached to the front squeegee at the proximal end of the channel, the seal flap being biased in a closed position within the channel where distal end of the seal flap is in direct contact with the front squeegee to substantially seal the channel, the seal flap being movable to an open position at least partially outside the channel where the distal end of the seal flap is not in direct contact with the front squeegee;

b. a rear squeegee having a lower edge for engaging the surface to be cleaned, the rear squeegee being mounted in close proximity to the front squeegee to define a vacuum chamber there between;

c. wherein when the surface cleaning machine is moved in the first direction, engagement of the seal flap and the surface to be cleaned causes the seal flap to move to the open position, allowing fluid to pass through the channel; and d. wherein when the lower edge of the front squeegee is partially disengaged from the surface to be cleaned, the seal flap is biased back to the closed position, reducing or preventing the fluid from passing through the channel.

2. The squeegee assembly of claim 1 wherein the channel has a first length between distal end and the proximal end thereof, wherein the seal flap has a second length between the distal end and the proximal end thereof and wherein the second length is greater than the first length so that the seal flap partially extends below the lower edge of the front squeegee to engage the surface to be cleaned.

3. The squeegee assembly of claim 1 wherein the channel has a first length between the distal end and the proximal end thereof, wherein the seal flap is integral with the front squeegee and includes a projection extending from the distal end thereof so that the seal flap has a second length between the proximal end and the projection that is longer than the first length so that the projection extends beyond the lower edge of the front squeegee to engage the surface to be cleaned.

4. The squeegee assembly of claim 1 wherein the seal flap is mounted to the front squeegee for movement between the open and closed position.

5. The squeegee assembly of claim 1 wherein the channel and the seal flap have complimentary configurations above the lower edge of the front squeegee so that in the seal flap closed position, the seal flap and channel are substantially in mating relationship.

6. The squeegee assembly of claim 1 wherein the channel and the seal flap have complimentary three dimensional configurations above the lower edge of the front squeegee so that in the seal flap closed position, the seal flap and channel are substantially in mating relationship.

7. The squeegee assembly of claim 1 wherein the channel has a first length between the distal end and the proximal end thereof, wherein the seal flap has a second length between the distal end and the proximal end thereof and wherein the second length is greater than the first length so that the seal flap partially extends below the lower edge of the front squeegee to engage the surface to be cleaned and a second end of the seal flap can have any configuration.

8. The squeegee assembly of claim 1 wherein the front squeegee has a plane, wherein the seal flap partially extends below the lower edge of the front squeegee to engage the surface to be cleaned and a second end of the seal flap has a half-diamond configuration where edges of the seal flap that define the half-diamond configuration are oriented in the plane of the front squeegee.

9. The squeegee assembly of claim 1 wherein the squeegee and seal flaps is composed of natural and synthetic flexible materials, including, but not limited to one or more of the following: rubber, polyurethane, silicone, fabric and plastic.

10. The squeegee assembly of claim 1 wherein the squeegee is fabricated by injection molding, cast molding, compression molding, open cast, extruded or fabricated from sheet material.

11. A squeegee assembly for a scrubber-dryer floor cleaning machine that is movable in a first direction, the squeegee assembly including:

a. a front squeegee having a lower edge for engaging a floor, the lower edge having at least one channel formed therein, wherein the channel has a distal end and a proximal end where the distal end is at the lower edge, a seal flap having a distal end and a proximal end, wherein the seal flap is positioned within the at least one channel so that the proximal end of the seal flap is attached to the front squeegee at the proximal end of the channel, wherein the channel has a first length between distal end and the proximal end thereof, wherein the seal flap has a second length between the distal end and the proximal end thereof and wherein the second length is greater than the first length so that the seal flap partially extends below the lower edge of the front squeegee, the seal flap being biased in a closed position where the distal end of the seal flap is in direct contact with the front squeegee to prevent fluid from passing through the channel but movable to an open position at least partially outside the channel where the distal end of the seal flap is not in direct contact with the front squeegee to allow the fluid to pass through the channel;

b. a rear squeegee having a lower edge for engaging the floor, the rear squeegee being mounted in close proximity to the front squeegee to define a vacuum chamber there between;

c. wherein the seal flap is caused to move from the closed position to the open position upon movement of the scrubber-dryer floor cleaning machine in the first direction, to allow fluid to enter the vacuum chamber through the channel; and d. wherein, when the lower edge of the front squeegee partially disengages from the floor, the seal flap is biased back to the closed position, preventing fluid from passing through the channel.

12. The squeegee assembly of claim 11 wherein the squeegee is composed of natural and synthetic flexible materials, including, but not limited to one or more of the following: rubber, polyurethane, silicone, fabric and plastic.

13. A squeegee assembly for a scrubber-dryer floor cleaning machine that has a vacuum, the squeegee assembly including:

a. a front squeegee having a lower edge for engaging a floor, the lower edge having at least one channel formed therein, wherein the channel has a distal end and a proximal end where the distal end is at the lower edge, a seal flap having a distal end and a proximal end, wherein the seal flap is positioned within the at least one channel so that the proximal end of the seal flap is attached to the front squeegee at the proximal end of the channel, wherein the channel has a first length between distal end and the proximal end thereof, wherein the seal flap has a second length between the distal end and the proximal end thereof and wherein the second length is greater than the first length so that the seal flap partially extends below the lower edge of the front squeegee, the seal flap being biased in a closed position where the distal end of the seal flap is in direct contact with the front squeegee to prevent the fluid from passing through the channel but movable to an open position at least partially outside the channel where the distal end of the seal flap is not in direct contact with the front squeegee to allow the fluid to pass through the channel;

b. a rear squeegee having a lower edge for engaging a floor, the rear squeegee being mounted in close proximity to the front squeegee to define a vacuum chamber there between;

c. wherein the seal flap is caused to move from the closed position to the open position by a force applied by the scrubber-dryer floor cleaning machine vacuum, to allow the fluid to enter the vacuum chamber through the channel; and d. wherein, when the lower edge of the front squeegee disengages from the floor, the seal flap is biased back to the closed position, preventing the fluid from passing through the channel.

* * * * *